US009004645B2

(12) United States Patent
Kanemoto

(10) Patent No.: US 9,004,645 B2
(45) Date of Patent: Apr. 14, 2015

(54) BELT CLEANING DEVICE, MEDIUM FEEDING DEVICE, AND INKJET RECORDING DEVICE

(71) Applicant: Seiko Epson Corporation, Tokyo (JP)

(72) Inventor: Shuichi Kanemoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/015,210

(22) Filed: Aug. 30, 2013

(65) Prior Publication Data

US 2014/0063122 A1 Mar. 6, 2014

(30) Foreign Application Priority Data

Aug. 31, 2012 (JP) ..... 2012-191467

(51) Int. Cl.
*B41J 29/17* (2006.01)
*B41J 2/165* (2006.01)

(52) U.S. Cl.
CPC ..... *B41J 2/16538* (2013.01); *B41J 29/17* (2013.01)

(58) Field of Classification Search
USPC ..... 347/33
See application file for complete search history.

(56) References Cited

U.S. PATENT DOCUMENTS

| | | | | |
|---|---|---|---|---|
| 7,901,030 | B2 | 3/2011 | Miyata et al. | |
| 2006/0028660 | A1 | 2/2006 | Lim | |
| 2007/0146460 | A1* | 6/2007 | Gordon et al. | 347/103 |
| 2007/0171251 | A1* | 7/2007 | Sekimoto et al. | 347/22 |
| 2009/0073222 | A1* | 3/2009 | Hori | 347/33 |

FOREIGN PATENT DOCUMENTS

| | | | |
|---|---|---|---|
| EP | 1160090 | A1 | 12/2001 |
| EP | 1160091 | A1 | 12/2001 |
| EP | 1291182 | A1 | 3/2003 |
| EP | 2281690 | A1 | 2/2011 |
| JP | 2000-127362 | A | 5/2000 |
| JP | 2008-114991 | A | 5/2008 |
| JP | 2012-116619 | A | 6/2012 |

OTHER PUBLICATIONS

The extended European Search Report for European Application No. 13182648.9 mailed Nov. 8, 2013.

* cited by examiner

*Primary Examiner* — Stephen Meier
*Assistant Examiner* — Alexander D Shenderov
(74) *Attorney, Agent, or Firm* — Global IP Counselors, LLP

(57) ABSTRACT

To provide a belt cleaning device and the like by which a more compact apparatus overall can be configured without compromising the ability to replace a secondary wiping member or the like, the invention is provided with a wiper which is provided on an inner side of a cleaning vessel and further downstream than a rotating brush in a direction of travel of a conveyance belt, and wipes off in a relative fashion a cleaning solution that has attached to the conveyance belt. The wiper includes a primary wiping blade and a secondary wiping blade which are in contact with the surface of the conveyance belt, and a primary fixation plate and a secondary fixation plate which are attached to the inner side of the cleaning vessel and to which the primary wiping blade and the secondary wiping blade, respectively, are fixed. An axis line of a fixation section formed in the secondary fixation plate is tilted toward the upstream side in the direction of travel and is prevented from intersecting with the primary fixation plate.

7 Claims, 3 Drawing Sheets

BELT CLEANING DEVICE, MEDIUM FEEDING DEVICE, AND INKJET RECORDING DEVICE

CROSS-REFERENCE TO RELATED APPLICATIONS

This application claims priority to Japanese Patent Application No. 2012-191467 filed on Aug. 31, 2012. The entire disclosure of Japanese Patent Application No. 2012-191467 is hereby incorporated herein by reference.

BACKGROUND

1. Technical Field

The present invention relates to a belt cleaning device, medium feed device, and inkjet recording device in which a conveyance belt for feeding a recording medium is cleaned with a cleaning solution.

2. Background Technology

A well-known leaning device is provided with: a water receiving section which collects cleaning water and an upper section of which is open; a brush roller which partially projects out from the upper section opening of the water receiving section and is accommodated in the water receiving section, and which cleans with the cleaning water the surface of an endless belt for conveying a recording medium; sheet-shaped flexible member on an upstream side and an elastic support member on a downstream side, which are provided on an inner side of the water receiving section and further downstream than the brush roller in a direction of travel of the endless belt, and wipes off in a relative fashion a cleaning solution that has attached to the endless belt; and an attachment section formed in an L-shape of a piece by to which the sheet-shaped flexible member is attached and a piece to which the elastic support member is attached (see Patent Document 1).

Japanese Laid-open Patent Publication No. 2008-114991 (Patent Document 1) is an example of the related art.

SUMMARY

Problems to be Solved by the Invention

In such a cleaning device (belt cleaning device), instead of the attachment section, it would be conceivable to attach, to the water receiving section (a cleaning vessel), a primary fixation member for fixing a primary wiping member on an upstream side and a secondary fixation member for screw-fastening a secondary wiping member on a downstream side, as well as to dispose the primary fixation member and the secondary fixation member in close proximity to each other in order to achieve a more compact apparatus overall. Then, in cases such as where the secondary wiping member is to be replaced, conceivably the primary fixation member is provided below the secondary fixation member and a screw hole formed in the secondary fixation member is positioned above an upper end of the primary fixation member, thereby preventing an axis line of the screw hole from intersecting with the primary fixation member (causing the axis line of the screw hole to be horizontal), so as to prevent the primary fixation member from being a hindrance when a fixation screw, which is screwed into the screw hole formed in the secondary fixation member, is accessed with a screw driver or the like. However, in such a case, the free length of the secondary wiping member (the length of outward projection from the primary fixation member) must be lengthened by however much the primary fixation member is provided below the secondary fixation member. In so doing, in order for the primary wiping member to come into contact with (wipe) the surface of the endless belt (a conveyance belt) with an appropriate contact pressure, either the thickness of the secondary wiping member must be increased or the material used must be special, and therefore the configuration is not reasonable.

The invention addresses the problem of providing a belt cleaning device, medium feed device, and inkjet recording device by which a more compact apparatus overall can be configured without compromising the ability to replace wiping members or the like.

Means Used to Solve the Above-Mentioned Problems

A belt cleaning device of the invention is characterized by being provided with: a cleaning member for cleaning, with a cleaning solution, a surface of a conveyance belt for conveyance an article to be conveyed; and a wiper that is provided further downstream than the cleaning member in a direction of travel of the conveyance belt, and relatively wipes off cleaning solution that has attached to the conveyance belt; the wiper including a primary wiping member in contact with the surface of the conveyance belt, a secondary wiping member provided further downstream than the primary wiping member in the direction of travel and in contact with the surface of the conveyance belt, a primary fixation member to which the primary wiping member is fixed, and a secondary fixation member to which the secondary wiping member is fixed; and an axis line of a fixation section for fixing the secondary wiping member, which fixation section is formed on the secondary fixation section, being tilted toward the upstream side in the direction of travel and not intersecting with the primary fixation member. In such a case, preferably, further provided is a cleaning vessel which collects the cleaning solution and an upper section of which is opened, the cleaning member partially projecting out from an upper section opening of the cleaning vessel and being accommodated in the cleaning vessel, and the primary fixation member and secondary fixation member being attached to an inner side of the cleaning vessel.

According to this configuration, because the axis line of the fixation section for fixing the secondary wiping member is tilted toward the upstream side in the direction of travel, the axis line of the fixation section can be prevented from intersecting with the primary fixation member even without the primary fixation member being provided below the secondary fixation member. For this reason, should the fixation section be, for example, a screw hole, then even in a case where the primary fixation member for fixing the primary wiping member and the secondary fixation member for fixing by screw-fastening the secondary wiping member are disposed in close proximity, the primary fixation member will still not be a hindrance when a fixation screw screwed into the screw hole is being accessed with a tool such as a driver from the upstream side in the direction of travel. As such, a more compact apparatus overall can be configured without compromising the ability to replace the secondary wiping member or the like.

In such a case, preferably, a bend section that bends to the outside of the vessel and has an inclined upper end section is formed in a wall section on a downstream side of the cleaning vessel in the direction of travel, the primary fixation member is attached to a vertical section below the bend section, and the secondary fixation member is formed in a planar shape and is attached diagonally along an inclined section above the bend section.

According to this configuration, attaching the secondary fixation member, formed in a planar shape, diagonally along the inclined section of the cleaning vessel causes the axis line of the screw hole formed in the secondary fixation member to be upwardly inclined diagonally toward the upstream side in the direction of travel. Then, attaching the secondary fixation member and the primary fixation member to above and below (the inclined section and the vertical section) on the bent section formed in the wall section on the downstream side of the cleaning vessel in the direction of travel makes it possible to dispose the primary fixation member closer against the wall section on the downstream side in the direction of travel in comparison to a case where the primary fixation member is attached to the secondary fixation member. For this reason, the length of the cleaning vessel in the direction of travel can be reduced, and a more compact configuration can be achieved.

A medium feed device of the invention is characterized by being provided with the above-described belt cleaning device and a belt conveyance unit which includes a conveyance belt and conveys a recording medium.

According to this configuration, being provided with the belt cleaning device which makes it possible to configure a more compact apparatus overall without compromising the ability to replace the secondary wiping member or the like makes it easy to replace the secondary wiping member and the like, and makes it possible to increase the degree of freedom of the installation of the belt cleaning device.

In such a case, preferably, the conveyance belt travels in the horizontal direction when at a position of being wiped off by the wiper, and the secondary wiping member is constituted of a wiping blade formed to a rectangular cross-section and fixed diagonally along the secondary fixation member.

According to this configuration, even in a case where a typical wiping blade having a rectangular cross-section is used, a corner of the wiping blade can still be abutted against the surface of the conveyance belt traveling in the horizontal direction, to efficiently wipe off the cleaning solution. For this reason, the need to use a specially shaped wiping blade can be obviated, thus reducing costs.

An inkjet recording device of the invention is characterized by being provided with the above-described medium feed device, and a print section for printing onto the recording medium on the conveyance belt in an inkjet format.

According to this configuration, being provided with the medium feed device including the belt cleaning device which makes it possible to configure a more compact apparatus overall without compromising the ability to replace the secondary wiping member or the like makes it easy to replace the secondary wiping member and the like, and makes it possible to increase the degree of freedom of the installation of the belt cleaning device.

Another belt cleaning device of the invention is characterized by being provided with: a cleaning member for cleaning, with a cleaning solution, a surface of a conveyance belt for conveyance an article to be conveyed; and a wiper that is provided further downstream than the cleaning member in a direction of travel of the conveyance belt, and relatively wipes off cleaning solution that has attached to the conveyance belt; the wiper including a primary wiping member in contact with the surface of the conveyance belt, a secondary wiping member provided further downstream than the primary wiping member in the direction of travel and in contact with the surface of the conveyance belt, a primary fixation member to which the primary wiping member is fixed by screw-fastening, and a secondary fixation member to which the secondary wiping member is fixed; and an axis line of a screw hole for screw-fastening the primary wiping member, which screw hole is formed on the primary fixation member, being tilted diagonally upward toward the downstream side in the direction of travel and not intersecting with the secondary fixation member.

According to this configuration, because the axis line of the screw hole is tilted diagonally upward toward the downstream side in the direction of travel, the axis line of the screw hole can be prevented from intersecting with the secondary fixation member even without the secondary fixation member being provided below the primary fixation member. For this reason, even in a case where the primary fixation member for fixing the primary wiping member by screw-fastening and the secondary fixation member for fixing the secondary wiping member are disposed in close proximity, the secondary fixation member will still not be a hindrance when a fixation screw screwed into the screw hole is being accessed with a tool such as a driver from the downstream side in the direction of travel. As such, a more compact apparatus overall can be configured without compromising the ability to replace the primary wiping member or the like.

BRIEF DESCRIPTION OF THE DRAWINGS

Referring now to the attached drawings which form a part of this original disclosure.

DETAILED DESCRIPTION OF EXEMPLARY EMBODIMENTS

The following describes an inkjet recording device as in an embodiment of the invention, with reference to the accompanying drawings. The present inkjet recording device is one in which a design or the like is printed (imprinted) by inkjet printing using a dye ink specifically onto cloth (original fabric) that is fed/withdrawn in a so-called reel-to-reel format. In the description that follows, a direction of forward/reverse feeding of a recording medium, which is a cloth, is set forth as the X-axis direction, and a direction orthogonal to the X-axis direction is set forth as the Y-axis direction.

Figure 1:
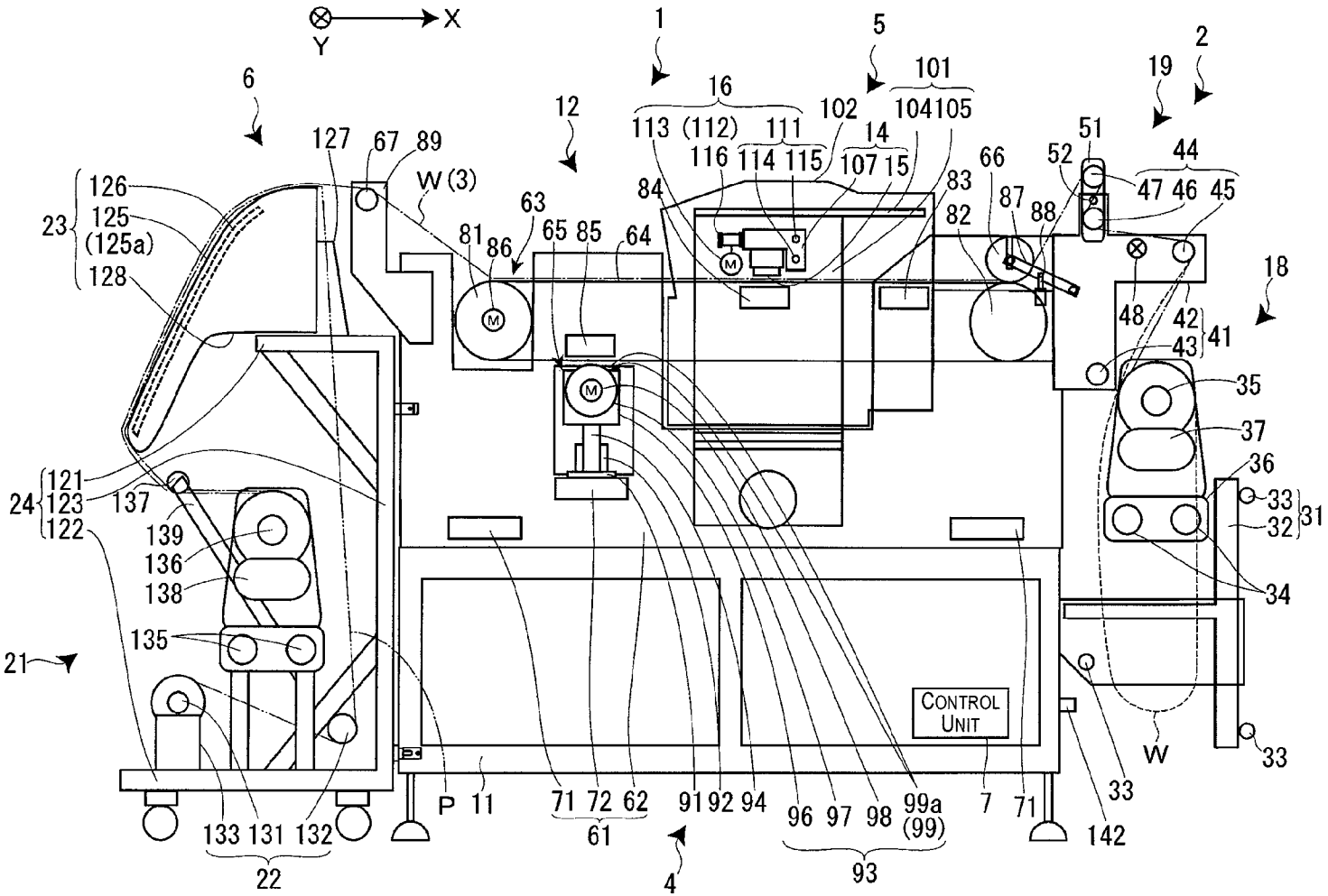
FIG. 1 is a cross-sectional structural view schematically representing an inkjet recording device as in an embodiment.

FIG. 1 is a cross-sectional structural view of the inkjet recording device. As illustrated in FIG. 1, the present inkjet recording device 1 is provided with: a feeding section 2 for feeding out a recording medium W that has been wound into a roll shape; a main device body 4 for feeding the recording medium W that has been fed out along a feed path 3, for the purpose of printing; a print section 5 that is disposed on an upper side of the main device body 4 and prints by inkjet printing onto the recording medium W in cooperation with the main device body 4; a wind-up section 6 for winding up and recovering the recording medium W that has been printed by the print section 5, on a downstream side of the main device body 4 in the feed direction; and a control unit 7 that has overarching control of these constituent devices.

The main device body 4 includes a main body chassis 11 constructed out of sheets of steel material, and a medium feed mechanism 12 that is supported by the main body chassis 11 and intermittently feeds the recording medium W in the X-axis direction by belt conveyance. The print section 5 includes a carriage unit 14 having an inkjet head 15, and a head movement mechanism 16 for reciprocatingly moving the carriage unit 14 in the Y-axis direction. The feeding section 2, in turn, includes a feeding-out unit 18 for feeding out the recording medium W, and a slack take-up unit 19 for taking up the slack of the recording medium W that has been fed out. The wind-up section 6 includes a wind-up unit 21 for winding up the recording medium W, an interleaf paper unit 22 for supplying interleaf paper P to the wind-up unit 21, and a heater unit 23 for gasifying the solvent (moisture) of a dye ink that has soaked into the recording medium W before the recording medium W is wound up; the wind-up section 6 is configured with these elements mounted onto a wind-up section chassis 24.

Fed out from the feeding-out unit 18, the recording medium W (a cloth) is stretched by the slack take-up unit 19 so that the slack is taken up, and fed into the medium feed mechanism 12. Having been fed into the medium feed mechanism 12, the recording medium W is made to be adhered to the surface and conveyed by belt. In this belt conveyance, the recording medium W is intermittently conveyed in the X-axis direction (secondary scanning) whereas the carriage unit 14 moves reciprocatingly in the Y-axis direction synchronously therewith, and ink is ejected from the inkjet head 15 (primary scanning).

After printing is carried out in this manner, the printed portion (imprinted portion) of the recording medium W is fed out to the wind-up section 6 from the medium feed mechanism 12. In the wind-up section 6, the interleaf paper P is supplied continuously from the interleaf paper unit 22 to the recording medium W that has been fed out from the medium feed mechanism 12, and the recording medium W and the interleaf paper P are stacked up onto each other and fed to the heater unit 23. In the heater unit 23, the recording medium W is heated along with the interleaf paper P, thus gasifying the solvent (moisture) of the dye ink. The imprinted recording medium W having undergone drying treatment in this manner is wound up by the wind-up unit 21 along with the interleaf paper P.

The feeding-out unit 18 includes: a feeding frame 31 including a pair of left and right (Y-axis direction) T-shaped frames 32 fixed to the main body chassis 11 as well as a plurality of rod-shaped frames 33 crossing over between the pair of T-shaped frames 32; two feed-out-side rod bases 34 that are supported by the pair of T-shaped frames 32 so as to be slidable in the Y-axis direction and extend in the Y-axis direction; and a pair of feeding axial projections 35 that are slidably supported by the two feed-out-side rod bases 34. A distal end section of each of the feeding axial projections 35 is formed in a circular truncated cone shape, and relative widthwise alignment corresponding to the width of the recording medium W causes the distal end sections of the pair of feeding axial projections 35 to be fitted into a feed-out core of the roll of recording medium W, thus horizontally supporting the recording medium W.

A motor-driven width movement unit 36 causes the pair of feeding axial projections 35 to move integrally left and right (the width direction of the recording medium W) via the two feed-out-side rod bases 34. When positional displacement of the recording medium W in the width direction is detected by a meandering detection sensor 48 (described below), the pair of feeding axial projections are moved minutely left or right. This prevents positional displacement of the recording medium W in the width direction in relation to the medium feed mechanism 12, i.e., prevents the recording medium W from meandering (skewing) in the medium feed mechanism 12 in a case where ear sections (width ends) of the wound-up recording medium W take the shape of a bamboo shoot and the recording medium W experiences winding displacement in the width direction.

A motor-driven rotation unit 37 is incorporated into one of the pair of feeding axial projections 35, and the motor-driven rotation unit 37 causes the pair of feeding axial projections 35 to rotate so as to feed out, thus feeding out the recording medium W. Furthermore, a reflection-based optical sensor 142 (see FIG. 2) for detecting whether or not there is recording medium W that has been fed out from the feeding-out unit 18 is provided below the feeding-out unit 18.

In the present embodiment, there is a tension mode for feeding out the recording medium W while also imparting thereto a constant tension, and a slack mode for feeding out the recording medium W with the greatest possible reduction in tension, where the mode is switched depending on the recording medium W. A graphical user interface (GUI) button makes it possible to switch between the tension mode and the slack mode on an operation screen (not shown) provided to the print section 5.

The tension mode is intended for normal cloth of low stretchability (the recording medium W), in which case a control unit 7 constituted of, for example, a personal computer controls the rotation unit 37 so that a required tension is imparted to the recording medium W and the recording medium W is fed out toward a first roller 45. More specifically, by controlling the torque of the motor of the rotation unit 37, the control unit 7 drives the rotation unit 37 so as to feed out the recording medium W during an operation for feeding out the recording medium W by the medium feed mechanism 12, and drives the rotation unit 37 so as to slightly rewind the recording medium W during cessation of the feeding of the recording medium W by the medium feed mechanism 12. The recording medium W is thereby fed in a state where tension is imparted to the recording medium W that is between the feeding-out unit 18 and the slack take-up unit 19.

The slack mode, in turn, is intended for cloth of high stretchability (the recording medium W), such as, for example, stocking material, in which case the control unit 7 controls the rotation unit 37 so that the recording medium W having been fed out, once slackened downward, is then fed into the slack take-up unit 19 (in FIG. 1, the slackened portion of the recording medium W is illustrated with a dotted line). That is to say, the amount of slack of the recording medium W is reduced in association with the operation for feed the recording medium W by the medium feed mechanism, and the control unit 7 drives the rotation unit 37 to rotate forward so as to feed out the recording medium W, thereby increasing the amount of slack, when the optical sensor 142 provided below the feeding-out unit 18 detects "NO" for the recording medium W, but stops the driving of the rotation unit 37 when the optical sensor 142 detects "YES" for the recording medium W. This control of the amount of slack allows for the recording medium W to be fed in a state where the recording medium W that is between the feeding-out unit 18 and the slack take-up unit 19 has been appropriately slackened.

The slack take-up unit 19 includes: a slack take-up frame 41 composed of a pair of left and right (Y-axis direction) L-shaped frames 42 fixed to a side frame 62 of the medium feed mechanism 12 (described below), and a rod frame 43 traversing the pair of L-shaped frames 42; and a roller group 44 rotatably supported with bilateral anchoring by the pair of L-shaped frames 42. The roller group 44 includes a first roller 45, a second roller 46, a third roller 47, and a fourth roller 48, disposed in the stated order from the upstream side of the feed direction, in order to create a plurality of bends in the feed path 3 of the recording medium W that has been fed in from the feeding-out unit 18, and is constituted of rollers each of a high coefficient of friction.

The recording medium W having been fed out from the feeding-out unit 18 takes a U-turn at the first roller 45 and arrives at the second roller 46 and the third roller 47. The second roller 46 and the third roller 47 are disposed in close proximity in the vertical direction, and are rotatably supported by a pair of bearing sections 51 with both end sections integrally formed. Each of the bearing sections 51 is rotatably supported by the L-shaped frames 42, and one of the bearing sections 51 has incorporated thereinto an angle adjustment unit 52 for adjusting the vertically directed placement angle between the second roller 46 and the third roller 47.

Passing through the second roller 46 and the third roller 47, the recording medium W is rerouted in an S-shaped manner, but this S-shaped curve can be adjusted by deformation depending on the type of recording medium W, making it possible to impart a tension suitable for the specific type of recording medium W. This eliminates any partial slackening or wrinkling for when the recording medium W is being fed into the medium feed mechanism 12. Preferably, the rollers 45, 46, 47 are given a drum-shaped structure so that an outwardly directed component force acts on the recording medium W from the center. The meandering detection sensor 48 is provided between the first roller 45 and the second roller 46.

The medium feed mechanism 12 is provided with: a main body frame 61 having the pair of left and right (Y-axis direction) side frames 62 placed atop and fixed to the main body chassis 11; a belt conveyance unit 63 which is supported by the pair of side frames 62 and includes an endless conveyance belt 64; and a belt cleaning unit 65 disposed on a lower side of the belt conveyance unit 63. The medium feed mechanism 12 is provided with a pressing roller 66 facing the belt conveyance unit 63 from above on the upstream side, and a separation roller 67 disposed diagonally above in relation to the belt conveyance unit 63 on the downstream side.

The main body frame 61 includes: the pair of side frames 62, which are constituted of thick plates; and a pair of front and rear (X-axis direction) connecting frames 71 for connecting the pair of side frames 62; and is placed atop and fixed to the main body chassis 11 at the portion where the pair of side frames 62 are. The main body frame 61 also includes a support frame 72 that is positioned between the pair of connecting frames 71 and connects the pair of side frames 62, and that supports the belt cleaning unit 65. A cut-out section for attaching the belt conveyance unit 63 and a cut-out section for attaching the print section 5 are provided as appropriate to each of the side frames 62; also formed is an opening for inspecting the belt cleaning unit 65.

The belt conveyance unit 63 includes a drive pulley 81 positioned on the downstream side in the feed direction, a driven pulley 82 positioned on the upstream side in the feed direction, and the endless conveyance belt 64, which spans between the drive pulley 81 and the driven pulley 82. The belt conveyance unit 63 includes a first guide plate 83 that is positioned in the vicinity of the driven pulley 82 and guides the travel of the conveyance belt 64, a second guide plate 84 that is positioned directly below the print section 5 and guides the travel of the conveyance belt 64, and a third guide plate 85 that is positioned directly above the support frame 72 and guides the travel of the conveyance belt 64 that has wrapped around to the reverse side.

The first guide plate 83 and the second guide plate 84 span across the pair of side frames 62 while disposed in such a manner that the surfaces of each are flush with each other (on the same horizontal plane), and also function as a part of the main body frame 61. The first guide plate 83 guides so that the (upper side of) the conveyance belt 64 that is immediately behind away from the driven pulley 82 travels horizontally, and the second guide plate 84 guides so as to prevent the (upper side of) the conveyance belt 64 that is positioned in a print region from experiencing slackening. As such, the conveyance belt 64 that is positioned directly above the second guide plate 84 functions as a platen. Additionally, the third guide plate 85 guides so as to hold the conveyance belt 64 receiving an upwardly pushing force because of the belt cleaning unit 65 (to be described in greater detail below). The conveyance belt 64 (of the lower side) that is immediately behind away from the drive pulley 81, too, travels horizontally. In other words, when at a position being cleaned by the belt cleaning unit 65, the conveyance belt 64 travels horizontally.

The drive pulley 81 and the driven pulley 82 are rotatably supported by the pair of side frames 62, via a dedicated bearing, and a conveyance motor 86 for intermittently causing the conveyance belt 64 to travel is connected to one of the axial ends of the drive pulley 81. The conveyance belt is constituted of a wide, special belt that is adhesive (has been adhesive-treated) on the outer peripheral surface (the surface); the recording medium W adheres thereto and is fed in the X-axis direction. This causes the recording medium W to be fed (intermittently fed) and printed on, without producing a turn or the like, directly below the print section 5.

The pressing roller 66, by which the recording medium W having been fed in from the slack take-up unit 19 is adhered to the conveyance belt 64, is disposed on an upper side of the driven pulley 82. The pressing roller 66 is rotatably supported by a distal end section of a pair of support frames 87 rotatably supported by the side frames 62. The pressing frame 66 has a predetermined elasticity and weight, and is caused by gravity to push the recording medium W against the conveyance belt 64 at directly above the driven pulley 82. That is to say, the pressing roller 66 and the driven pulley 82 function as nip rollers sandwiching the conveyance belt 64, and continuously adhere the recording medium W to the traveling conveyance belt 64. An air cylinder 88 for causing the support frames 87 to rotate is connected to an intermediate position of each of the support frames 87, and synchronously driving the pair of air cylinders 88 causes the pressing roller 66 to be pulled apart from the conveyance belt 64.

Meanwhile, the separation roller 67, which peels the printed recording medium W away from the conveyance belt 64 and feeds the recording medium W into the wind-up section 6, is disposed diagonally above the drive pulley 81. The separation roller 67 is rotatably supported by a pair of subframes 89 that extend from the side frames 62. Here, the separation roller 67 is for pulling the recording medium W in a relative fashion away from the conveyance belt 64 which revolves about the drive pulley 81 and wraps around to the reverse side, but in actual operation, the force of pulling away from the conveyance belt 64 would vary depending on the type of recording medium W. For this reason, depending on the recording medium W, in some instances peeling away begins at a position where the conveyance belt 64 begins revolution, and in other instances peeling begins at a position where revolution has progressed a certain extent. However, were the point of pulling away to wrap around to the reverse side, there would be the potential for the recording medium W to be caught up into the conveyance belt 64.

Therefore, in the present embodiment, the angle of the recording medium W being fed into the separation roller 67 from the conveyance belt 64 is positionally detected, and the wind-up unit 21 is driven to wind up on the basis of the detection result of this positional detection, to prevent the point of pulling away from wrapping around to the reverse side of the conveyance belt 64.

The belt cleaning unit 65 regularly cleans the conveyance belt 64 because lint and dust attach over time to the conveyance belt 64, which is adhesive. The belt cleaning unit 65 is supported by the support frame 72 on the lower side of the conveyance belt 64, and extends in the Y-axis direction so as to traverse the conveyance belt 64. The configuration of the belt cleaning unit 65 shall be described below. Any cleaning solution ultimately remaining on the conveyance belt 64 will be wiped off with a waste cloth.

The print section 5 is provided with a printer frame 101 that extends in the Y-axis direction so as to straddle the feed path 3 (the belt conveyance unit 63), the head movement mechanism 16 supported by the printer frame 101, the carriage unit 14 that is mounted onto the head movement mechanism 16 and moves reciprocatingly in the Y-axis direction, and a printer cover 102 for covering these elements. Though not depicted in particular, a cleaning unit and cap unit for maintaining the inkjet head 15 are mounted onto the print section 5. A so-called paper gap (work gap) in the print section 5 ranges in thickness among the various types of recording medium W, and therefore is adjusted by vertically moving the entire print section 5 in relation to the main device body 4 (the medium feed mechanism 12).

The printer frame 101 includes a beam-shaped frame 104 made of sheet metal that extends in the Y-axis direction as well as a pair of erected frames 105 made of sheet metal that support the beam-shaped frame 104 at both end sections, and is supported by the side frames 62 at the portion where the erected frames 105 are. The printer cover 102 is attached to the printer frame 101.

The carriage unit 14 includes: the inkjet head 15, which has nozzle columns of a plurality of colors for color printing; and a carriage 107 for holding the inkjet head 15 so that a nozzle surface faces downward. Each of the colors of dye ink supplied to each of the nozzle columns is supplied from an ink tank of a so-called off-carriage.

The head movement mechanism 16 includes a carriage guide 111 for supporting the carriage unit 14 by cantilever so as to be slidable in the Y-axis direction, a belt conduction mechanism 112 for reciprocatingly moving the carriage guide 111, and a carriage motor 113 for driving the belt conduction mechanism 112. The carriage guide 111 is composed of a lower main guide 114 and an upper sub-guide 115; the main guide 114 and the sub-guide 115 are supported by the pair of erected frames 105 at both end sections thereof. The belt conduction mechanism 112 has a timing belt 116, and a part of the timing belt 116 is fixed to (the carriage 107 of) the carriage unit 14.

When the timing belt 116 is made to travel forward by the carriage motor 114, the carriage unit 14 is guided by the carriage guide 111 and moves reciprocatingly in the Y-axis direction. The moving position of the carriage guide 111 is detected by a linear encoder, and each of the colors of dye ink is selectively ejected from the inkjet head 15 on the basis of the detection result as well as print data. The recording medium W is thereby printed (imprinted).

The wind-up section 6 is provided with the wind-up section chassis 24 connected to the main body chassis 11 so as to be detachable in the X-axis direction, the heater unit 23 supported by an upper section of the wind-up section chassis 24, and the wind-up unit 21 and the interleaf paper unit 22 both supported by a lower section of the wind-up section chassis 24. Formats for the imprinted recording medium W include a format in which a thick recording medium W from which the ink is not offset is wound up without any alteration, and a format in which the interleaf paper is placed on a thin recording medium W from which the ink is prone to be offset and then same are wound up; the wind-up section 6 of the embodiment is designed to be capable of addressing both formats. A case where the latter format is employed shall now be described below.

The wind-up section chassis 24 will be described in greater detail below, but includes an upper horizontal frame section 121, a lower horizontal frame section 122, and a vertical frame section 123 to which the upper horizontal frame section 121 and the lower horizontal frame section 122 are connected, and is configured by combining extruded aluminum material in a criss-cross fashion. At the portion where the vertical frame section 123 is, the wind-up section chassis 24 is detachably connected to the main body chassis 11.

The heater unit 23 is provided with a heat dissipation plate 125 having an arc-shaped heat dissipation surface 125*a*, a heater 126 bonded to inside the heat dissipation plate 125, and a pair of left and right support plates 128 that are provided to both left and right end sections of an inner side of the heat dissipation plate 125 and have the shape of the trunk of an elephant. (The support plates 128 of) the heater unit 23 is attached to the upper horizontal frame section 121 by a left and right fixing member 127 provided to the upper horizontal frame section 121 in a state where an upper half section thereof has been placed on the upper horizontal frame section 121. An upper end section of the heat dissipation plate 125 is disposed at a position close to the separation roller 67 and slightly lower than the separation roller 67. The upper end section of the heat dissipation plate 125 is shaped so as to bend downward in an arc-shaped manner in order to reroute the interleaf paper P being guided into this portion from below.

Having passed through the separation roller 67, the recording medium W is overlapped with the interleaf paper P being fed in from below at the upper end section of the heat dissipation plate 125, and is fed downward guided by the arc-shaped outer surface (the heat dissipation surface 125*a*) of the heat dissipation plate 125. The recording medium W and the interleaf paper P, which are fed in the vertical direction while in sliding contact with the heat dissipation surface 125*a*, are continuously heated by the heater 126. This heating gasifies the solvent (moisture) of the dye pigment that has soaked into the recording medium W, thus fixing the dye to the cloth.

The interleaf paper unit 22 includes an interleaf paper roller 131 for feeding out a roll of the interleaf paper P, and a guide bar 132 for rerouting the fed-out interleaf paper P toward the upper end section of the heat dissipation plate 125. The guide bar 132 is fixed to a diagonal portion connecting the lower horizontal frame section 122 and the vertical frame section 123. The interleaf paper roller 131 is supported by a front section of the lower horizontal frame section 122, via a pair of bearing units 133 by which a braking mechanism is incorporated. This pair of bearing units 133 causes the interleaf paper P to be fed out without producing slackening.

The wind-up unit 21 is similar to the feeding-out unit 18 in including two winding-side rod bases 135 that are supported by a rear section of the lower horizontal frame section 122 and extend in the Y-axis direction, and a pair of wind-up axial projections 136 slidably supported by the two winding-side rod bases 135. The wind-up unit 21 also includes a tension roller 137 that is positioned on the feed path 3 between the lower end section of the heat dissipation plate 125 and the pair of wind-up axial projections 136, and imparts tension to the recording medium W and to the interleaf paper P.

A distal end section of each of the wind-up axial projections 136 is formed in a circular truncated cone shape, and relative widthwise alignment corresponding to the width of the recording medium W causes the distal end sections of the pair of wind-up axial projections 136 to be fitted into a wind-up core around which the recording medium W is wound up, thus horizontally supporting the recording medium W. A motor-driven rotation unit 138 is incorporated into one of the pair of wind-up axial projections 136, and the motor-driven rotation unit 138 causes the pair of wind-up axial projections 136 to rotate so as to wind up, thus simultaneously winding up both the recording medium W and the interleaf paper P. The rotation unit 138 is controlled on the basis of the detection of the angle of the recording medium W being fed to the separation roller 67, in the vicinity of the separation roller 67, as described above.

The tension roller 137 is rotatably supported by a distal end section 139 of a pair of rotating arms 139 rotatably supported by the rear section of the lower horizontal frame section 122. The tension roller 137 is in contact with and rotating on the recording medium W being wound up around the wind-up core as well as the interleaf paper P side of the interleaf paper P side, and gravity urges downward rotation of the recording medium W and the interleaf paper P. This imparts an appropriate tension to the recording medium W and to the interleaf paper P, and causes the recording medium W and the interleaf paper P to be wound up around the wind-up core so as to be wound tight.

Figure 2:
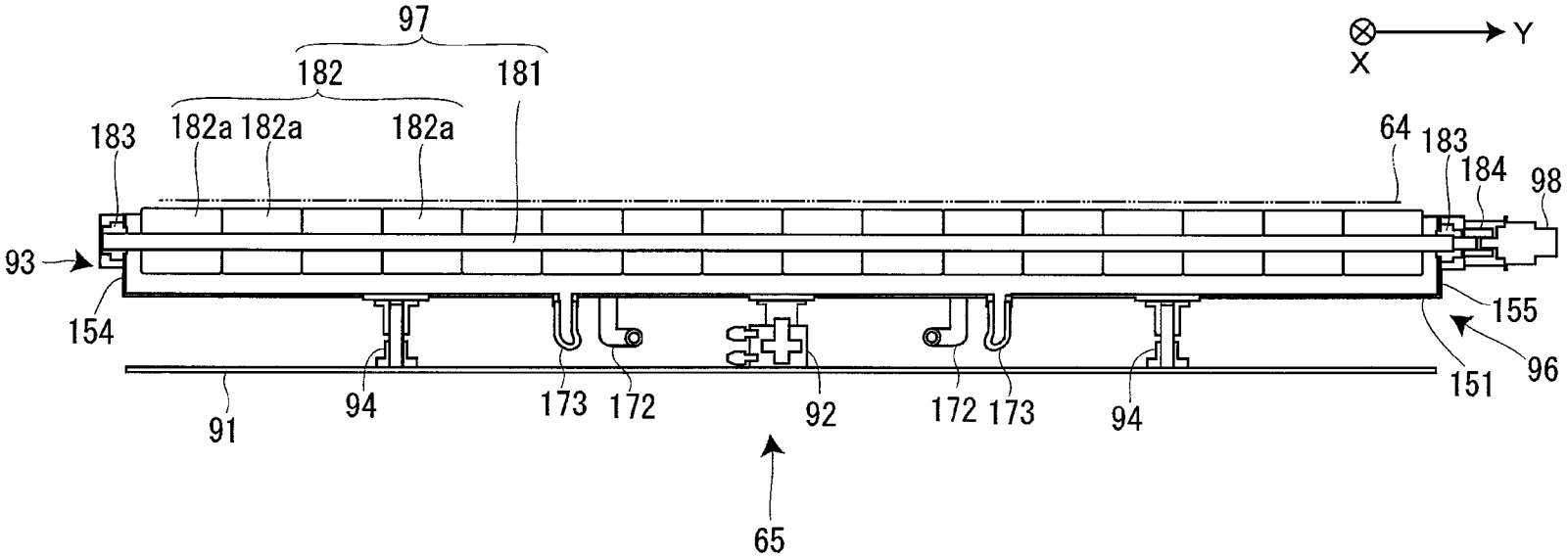
FIG. 2 is a cross-sectional structural view cutting through a belt cleaning unit in the inkjet recording device, along a line of section parallel to the Y-axis direction.
Figure 3:
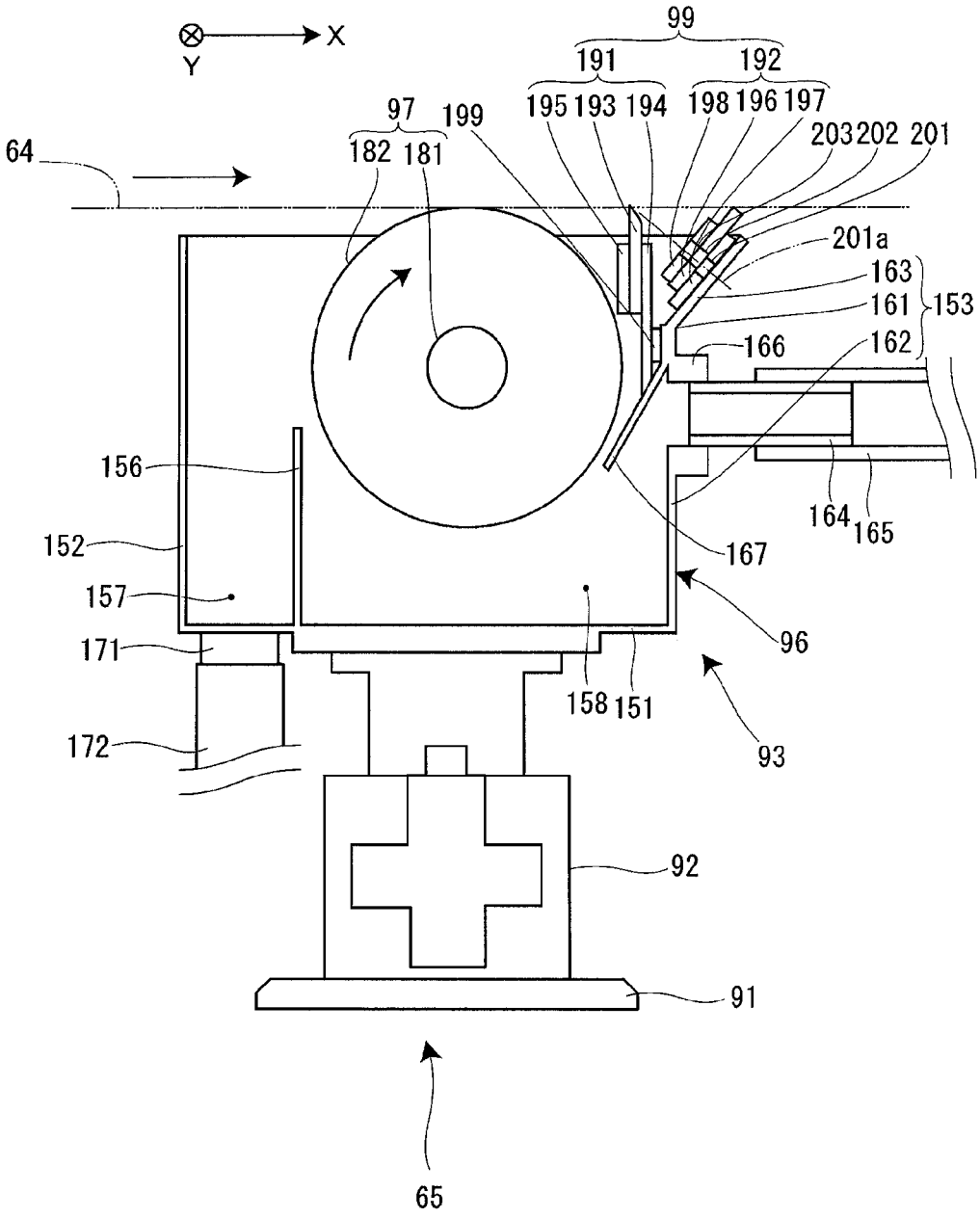
FIG. 3 is a cross-sectional structural view cutting through the belt cleaning unit in the inkjet recording device along a line of section parallel to the X-axis direction.

Next, the belt cleaning unit 65 shall now be described, with reference to FIGS. 2 and 3. In the description that follows, the "direction of travel" signifies the direction of travel of the conveyance belt 64 when at positions where the conveyance belt 64 is being cleaned by the belt cleaning unit 65. For this reason, the upstream side in the direction of travel will be the downstream side of the feed direction of the recording medium W, and the downstream side in the direction of travel will be the upstream side of the feed direction.

The belt cleaning unit 65 is provided with a unit base 91 that extends in the Y-axis direction and is placed on the support frame 72 (see FIG. 1), a vertical motion cylinder 92 provided so as to be erected at a substantially intermediate section of the unit base 91 in the Y-axis direction, a cleaning unit main body 93 that is vertically moved by the vertical motion cylinder 92, and a pair of left and right vertical motion guides 94 for guiding the vertical motion of the cleaning unit main body 93.

The cleaning unit main body 93 includes a cleaning vessel 96 that extends in the Y-axis direction and collects a cleaning solution, a rotating brush 97 that is accommodated in the cleaning vessel 96, a cleaning motor 98 for rotating the rotating brush 97, and a wiper 99 that is provided on an inner side of the cleaning vessel 96 and further downstream in the direction of travel than the rotating brush 97, and wipes in a relative manner the cleaning solution that has attached to the conveyance belt 64.

The cleaning vessel 96 is formed in a box shape, an upper section of which is open and which is longer in the Y-axis direction, and is constituted of a bottom wall 151, an upstream side wall 152 on the upstream side in the direction of travel, a downstream side wall 153 on the downstream side in the direction of travel, a left side wall 154 on the left side of the apparatus, and a right side wall 155 on the right side of the apparatus. Extending in the Y-axis direction in the interior of the cleaning vessel 96 is a partition wall 156 that is erected up to a substantially intermediate section in the height direction from the bottom wall 151 and partitions the vessel interior into two in the direction of travel (the X-axis direction). The cleaning vessel 96 is sectioned by the partition wall 156 into a smaller small chamber 157 on the upstream side in the direction of travel and a broader large chamber 158 on the downstream side in the direction of travel, the rotating brush 97 being accommodated in the large chamber 158. The partition wall 156 functions as a "dam" and upholds a constant level of liquid in the large chamber 158.

A bend section 161 that bends to the outside of the cleaning vessel 96 (to the downstream side in the direction of travel) and has an inclined upper end section is formed in the downstream side wall 153. That is to say, the downstream side wall 153 is constituted of a vertical section 162 that is below the bend section 161 and extends in the vertical direction, and an inclined section 163 that is above the bend section 161 and extends diagonally upward toward the downstream side in the direction of travel. Also formed on the (vertical section 162 of the) downstream side wall 153 is a cleaning solution supply port 166 to which a cleaning solution supply tube 165 is connected via a supply fitting 164 at a substantially intermediate section in the Y-axis direction. A shielding plate 167 that extends diagonally downward from the upper end section of the cleaning solution supply port 166 so as to shield off from the rotating brush 97 is formed in the cleaning solution supply port 166. Cleaning solution flowing in from the cleaning solution supply port 166 flows toward the bottom (the bottom wall 151) of the large chamber 158 due to the shielding plate 167. Waste and the like is thereby prevented from settling to the bottom of the large chamber 158.

In the bottom wall 151 of the small chamber 157, in turn, cleaning solution discharge ports (not shown) to which a cleaning solution discharge tube 172 is connected via a discharge fitting 171 on the side are formed at two points left and right (the Y-axis direction). The cleaning solution flows into the large chamber 158 from the cleaning solution supply port 166 and soaks the rotating brush 97 accommodated in the large chamber 158, and any cleaning solution that breaches the partition wall 156 and overflows into the small chamber 157 is discharged out from the cleaning solution discharge ports to the cleaning solution discharge tubes 172. Preferably, the cleaning solution is cycled to an external tank and back while being filtered. In the bottom wall 151 of the large chamber, in turn, a drain tube 173 is connected to two points left and right, allowing for removal of the cleaning solution that has collected in the large chamber 158, such as for maintenance.

The rotating brush 97 has a brush shaft 181 and a brush main body 182 fitted onto the brush shaft 181. The brush shaft 181 is pivotally supported by bilateral anchoring by a left and right brush bearing 183, and connected to one of the end sections thereof is an output shaft of the cleaning motor 98 (a geared motor) via a coupling 184. The brush main body 182 is configured by linking together a plurality of unit brushes 182*a*, formed in a short cylindrical shape, in an axial direction of the brush shaft 181, and overall has a width corresponding to the width of the conveyance belt 64. The lower end section of the rotating brush 97 is soaked with the cleaning solution collected in the large chamber 158, and the upper end section projects slightly out from the upper section opening of the cleaning vessel 96, thus being able to come into contact with the surface of the conveyance belt 64.

The wiper 99 is provided with a primary wiper 191 that is provided in the vicinity of the downstream side of the rotating brush 97 in the direction of travel and broadly wipes off the cleaning solution that has attached to the conveyance belt 64, and a secondary wiper 192 that is provided further downstream in the direction of travel than the primary wiper 191 and wipes off any cleaning solution remaining without having been wiped off by the primary wiper 191.

The primary wiper 191 includes a primary wiping blade 193 in contact with the surface of the conveyance belt 64, a primary fixation plate 194 which is provided further downstream in the direction of travel than the primary wiping blade 193 and to which the primary wiping blade 193 is fixed by screw-fastening, a primary holding member 195 which is provided further upstream in the direction of travel than the primary wiping blade 193 and which holds a base end section (lower end section) of the primary wiping blade 193 against the primary fixation plate 194, and a plurality of primary fixation screws (not shown) for fastening the primary holding member 195 to the primary fixation plate 194. The primary wiping blade 193, the primary fixation plate 194, and the primary holding member 195 have a standing posture (see FIG. 3) as seen in side view.

The secondary wiper 192, in turn, includes a secondary wiping blade 196 in contact with the surface of the conveyance belt 64 further downstream in the direction of travel than the primary wiping blade 193, a secondary fixation plate 197 which is provided diagonally below further downstream in the direction of travel than the secondary wiping blade 196 and to which the secondary wiping blade 196 is fixed by screw-fastening, a secondary holding member 198 which is provided diagonally above further upstream in the direction of travel than the secondary wiping blade 196 and which holds a base end section (lower end section) of the secondary wiping blade 196 against the secondary fixation plate 197, and a plurality of secondary fixation screws (not shown) for fastening the secondary holding member 197 to the secondary fixation plate 198. The secondary wiping blade 196, the secondary fixation plate 197, and the secondary holding member 198 have an inclined posture in which the upper end section is inclined to the downstream side in the direction of travel as seen in side view (see FIG. 3). That is to say, the primary wiping blade 193 and the secondary wiping blade 196 are disposed so as to substantially form an L-shape as seen in side view. The height positions of the distal end sections of the primary wiping blade 193 and the secondary wiping blade 196 are substantially the same as the height position of the upper end section of the rotating brush 97.

The primary wiping blade 193 is constituted of a comparatively softer elastic material (for example, silicon rubber) and has a substantially rectangular cross-sectional shape in which, at the distal end section (upper end section) thereof, the corner of the downstream side in the direction of travel being diagonally trimmed away and the upstream side in the direction of travel is an acute angle. This makes it possible to more efficiently wipe off (scrape off) the cleaning solution on the surface of the conveyance belt 64, but any typical wiping blade having a rectangular cross-sectional shape can be used, provided that the shape fit appropriately with the conveyance belt 64.

The primary fixation plate 194 is attached to an upper end inner side of the vertical section 162 of the downstream side wall 153 via a spacer 199 provided to a plurality of points. Though not shown, primary screw holes in which are formed internal threads into which the primary fixation screws are screwed, through holes (loose holes) perforated by the primary fixation screws, and attachment holes (loose holes) perforated by the primary fixation screws are formed in the primary fixation plate 194, in the primary wiping blade 193, and in the primary holding member 195, respectively, each spread out at a plurality of points in the Y-axis direction. Screwing the plurality of primary fixation screws into the primary fixation plate 194 fastens the primary holding member 195 to the primary fixation plate 194, and fixes by screw-fastening to the primary fixation plate 194 the primary wiping blade 193 sandwiched therebetween.

The secondary wiping blade 196, in turn, is constituted of a comparatively harder elastic material (for example, a urethane rubber), and has a rectangular cross-sectional shape. The secondary fixation plate 197 is attached diagonally along the inclined section 163 of the downstream side wall 153 in the vicinity of the primary fixation plate 194. Because the secondary wiping blade 196 is fixed diagonally along the secondary fixation plate 197, the corner of the secondary wiping blade 196 will abut against the surface of the conveyance belt 64 traveling in the horizontal direction. This makes it possible to more efficiently wipe off the cleaning solution even without the use of a specially shaped wiping blade, and makes it possible to lower costs.

Secondary screw holes 201 serving as fixation sections in which is formed an internal thread into which the secondary fixation screws are screwed, through holes 202 (loose holes) perforated by the secondary fixation screws, and pressing holes 203 (loose holes) perforated by the secondary fixation screws are formed in the secondary fixation plate 197, the secondary wiping blade 196, and the secondary holding member 198, respectively, each spread out at a plurality of points in the Y-axis direction, similarly with respect to the primary wiper 191 side. Screwing the plurality of secondary fixation screws into the secondary fixation plate 197 fastens the secondary holding member 198 to the secondary fixation plate 197 and fixes by screw-fastening to the secondary fixation plate 197 the secondary wiping blade 196 sandwiched therebetween.

The belt cleaning unit 65 configured in this manner regularly works to clean the conveyance belt 64. This conveyance work includes first lifting the cleaning unit main body 93 to a position at which the rotating brush 97 and the wiper 99 (the primary wiping blade 193 and the secondary wiping blade 196) are in contact with the conveyance belt 64. At this time, the conveyance belt 64 is pushed on by the third guide plate 85, and comes into contact with the rotating brush 97 while still maintained in a horizontal posture. Causing the conveyance belt 64 to travel and also rotating the rotating brush 97 continuously brushes clean the surface (adhesive surface) of the conveyance belt 64. Herein, the rotating brush 97 rotates in a forward direction in relation to the travel of the conveyance belt 64. For this reason, the cleaning solution, which is scattered at the instant the rotating brush 97 separates from the conveyance belt 64, will be oriented toward the wiper 99 and is prevented from being scattered to the exterior of the cleaning vessel 96. Then, the cleaning solution having attached to the conveyance belt 64 is scraped off by the primary wiping blade 193 and the secondary wiping blade 196. The scraped-off cleaning solution flows down along the surfaces of the primary wiper 191 and the secondary wiper 192, and returns to the large chamber 158.

Herein, attaching the secondary fixation plate 197 diagonally along the inclined section 163 of the cleaning vessel 96 as described above causes an axis line 201*a* of the secondary screw holes 201 formed in the secondary fixation plate 197 to be tilted diagonally upward toward the upstream side in the direction of travel. For this reason, even without having provided the secondary fixation plate 194 to below the secondary fixation plate 197, the axis line 201*a* of the secondary screw holes 201 can be oriented further upward than the upper end of the primary fixation plate 194 and prevented from intersecting with the primary fixation plate 194. For this reason, even in a case where the primary fixation plate 194 and the secondary fixation plate 197 have been disposed in close proximity, as in the present embodiment, the primary fixation plate 194 will not be a hindrance when the secondary fixation screws screwed into the secondary screw holes 201 are being accessed with a driver or the like from the upstream side in the direction of travel. As such, in cases such as where the secondary wiping blade 196 is being replaced, the secondary fixation screws can be readily loosened with a driver or the like, and also screwed in, and therefore the work of replacing same can be carried out quickly.

Further, attaching the primary fixation plate 194 to the vertical section 162 of the downstream side wall 153 and also attaching the secondary fixation plate 197 to the inclined section 163 of the downstream side wall 153 makes it possible to dispose the primary fixation plate 194 closer against the downstream side wall 153 than a case where the primary fixation plate 194 is attached to the secondary fixation plate 197. For this reason, the length of the cleaning vessel 96 in the direction of travel can be reduced, and a more compact configuration can be achieved.

In the present embodiment, the primary wiping blade 193, the primary fixation plate 194, and the primary holding member 195 are in an upright position as seen in side view and the secondary wiping blade 196, the secondary fixation plate 197, and the secondary holding member 198 are in an inclined posture in which the upper end sections are tilted to the downstream side in the direction of travel, but the configuration can also be the inverse thereof. That is to say, the primary wiping blade 193, the primary fixation plate 194, and the primary holding member 195 can be in an inclined posture in which the upper end sections are tilted to the upstream side in the direction of travel as seen in side view, the secondary wiping blade 196, the secondary fixation plate 197, and the secondary holding member 198 then being in an upright posture as seen in side view. Then, in such a case, the axis line of the primary screw holes formed in the primary fixation plate 194 will be tilted diagonally upward toward the downstream side in the direction of travel. This makes it possible for the axis line of the primary screw holes to be oriented further upward than the upper end of the secondary fixation plate 197 and prevented from intersecting with the secondary fixation plate 197, even without having provided the secondary fixation plate 197 to below the primary fixation plate 194. For this reason, even in a case where the primary fixation plate 194 and the secondary fixation plate 197 have been disposed in close proximity, the secondary fixation plate 197 will not be a hindrance when the primary fixation screws screwed into the primary screw holes are being accessed with a driver or the like from the downstream side in the direction of travel. Both the primary side and the secondary side can also be in the inclined posture.

In the present embodiment, both the primary wiper 191 and the secondary wiper 192 use wiping blades as a wiping member for wiping off the cleaning solution on the conveyance belt 64, but there is no limitation thereto, and, for example, the wipers can use a sheet shape or a brush shape. Also, the present embodiment describes the belt cleaning unit 65 for cleaning the conveyance belt 64 that conveys the recording medium W (cloth), but the invention could also be applied to a belt cleaning device for cleaning a conveyance belt that conveys another article to be conveyed. For example, the invention could be applied to a belt cleaning device for cleaning a conveyance belt that conveys a variety of functional sheets, such as a glass substrate or a light-polarizing sheet, in a process for manufacturing a liquid crystal display.

What is claimed is:

1. A belt cleaning device, comprising:

a cleaning member for cleaning, with a cleaning solution, a surface of a conveyance belt for conveyance an article to be conveyed; and a wiper that is provided further downstream than the cleaning member in a direction of travel of the conveyance belt, and relatively wipes off cleaning solution that has attached to the conveyance belt;

the wiper including a primary wiping member in contact with the surface of the conveyance belt, a secondary wiping member provided further downstream than the primary wiping member in the direction of travel and in contact with the surface of the conveyance belt, a primary fixation member to which the primary wiping member is fixed, and a secondary fixation member to which the secondary wiping member is fixed;

and an axis line of a fixation hole for fixing the secondary wiping member, which fixation hole is formed in the secondary fixation member, being tilted toward the upstream side in the direction of travel and not intersecting with the primary fixation member.

2. The belt cleaning device as set forth in claim 1, further comprising:

a cleaning vessel which collects the cleaning solution and an upper section of which is opened, the cleaning member partially projecting out from an upper section opening of the cleaning vessel and being accommodated in the cleaning vessel, and the primary fixation member and secondary fixation member being attached to an inner side of the cleaning vessel.

3. The belt cleaning device as set forth in claim 2, wherein a bend section that bends to the outside of the vessel and has an inclined upper end section is formed in a wall section on a downstream side of the cleaning vessel in the direction of travel, the primary fixation member is attached to a vertical section below the bend section, and the secondary fixation member is formed in a planar shape and is attached diagonally along an inclined section above the bend section.

4. A medium feed device, comprising:

the belt cleaning device as set forth in claim 2, and a belt conveyance unit which includes the conveyance belt and conveys the article to be conveyed.

5. The medium feed device as set forth in claim 4, wherein the conveyance belt travels in the horizontal direction when at a position of being wiped off by the wiper, and the secondary wiping member is constituted of a wiping blade formed to a rectangular cross-section and is fixed diagonally along the secondary fixation member.

6. An inkjet recording device, comprising:

the medium feed device as set forth in claim 4, and a print section for printing onto a recording medium, which is the article to be conveyed, on the conveyance belt in an inkjet format.

7. A belt cleaning device, comprising:

a cleaning member for cleaning, with a cleaning solution, a surface of a conveyance belt for conveyance an article to be conveyed; and a wiper that is provided further downstream than the cleaning member in a direction of travel of the conveyance belt, and relatively wipes off cleaning solution that has attached to the conveyance belt;

the wiper including a primary wiping member in contact with the surface of the conveyance belt, a secondary wiping member provided further downstream than the primary wiping member in the direction of travel and in contact with the surface of the conveyance belt, a primary fixation member to which the primary wiping member is fixed, and a secondary fixation member to which the secondary wiping member is fixed;

and an axis line of a fixation hole for fixing the primary wiping member, which fixation hole is formed in the primary fixation member, being tilted toward the downstream side in the direction of travel and not intersecting with the secondary fixation member.

* * * * *